US008837983B2

(12) United States Patent
Nakasone

(10) Patent No.: US 8,837,983 B2
(45) Date of Patent: Sep. 16, 2014

(54) PROCESS CARTRIDGE AND IMAGE FORMING APPARATUS

(71) Applicant: Oki Data Corporation, Tokyo (JP)

(72) Inventor: Yasushi Nakasone, Tokyo (JP)

(73) Assignee: Oki Data Corporation, Tokyo (JP)

( * ) Notice: Subject to any disclaimer, the term of this patent is extended or adjusted under 35 U.S.C. 154(b) by 6 days.

(21) Appl. No.: 13/630,396

(22) Filed: Sep. 28, 2012

(65) Prior Publication Data

US 2013/0084100 A1 Apr. 4, 2013

(30) Foreign Application Priority Data

Sep. 29, 2011 (JP) ..... 2011-213753

(51) Int. Cl.
*G03G 21/18* (2006.01)

(52) U.S. Cl.
CPC ..... *G03G 21/1814* (2013.01); *G03G 21/1821* (2013.01); *G03G 2215/0141* (2013.01); *G03G 21/1867* (2013.01)
USPC ..... 399/111; 399/117; 399/90

(58) Field of Classification Search
USPC ..... 399/90, 111, 117
See application file for complete search history.

(56) References Cited

U.S. PATENT DOCUMENTS 7,050,736 B2 * 5/2006 Hale et al. ..... 399/90

FOREIGN PATENT DOCUMENTS

| | | | |
|---|---|---|---|
| JP | 06-180544 | A | 6/1994 |
| JP | 08-328330 | A | 12/1996 |
| JP | 10-222040 | A | 8/1998 |
| JP | 2000-293049 | A | 10/2000 |

* cited by examiner

*Primary Examiner* — David Gray
*Assistant Examiner* — Michael Harrison
(74) *Attorney, Agent, or Firm* — Muncy, Geissler, Olds & Lowe, P.C.

(57) ABSTRACT

A process cartridge attachable to and detachable from an image forming device includes a photosensitive drum that is configured to form an electrostatic latent image, a flange that is arranged to the photosensitive drum, including a cylindrical attachment part, a frame that rotatably holds the flange, and a load member that is slidably press-fitted to the attachment part of the flange. The frame includes an engagement part that is configured to engage with a part of the load member, and a rotation of an end part of the load member is regulated by a regulation surface of the engagement part.

28 Claims, 13 Drawing Sheets

PROCESS CARTRIDGE AND IMAGE FORMING APPARATUS

CROSS REFERENCE TO RELATED APPLICATION

The present application is related to, claims priority from and incorporates by reference Japanese Patent Application No. 2011-213753, filed on Sep. 29, 2011.

TECHNICAL FIELD

The present invention relates to a process cartridge and an image forming apparatus that performs printing using the process cartridge.

BACKGROUND

Conventionally, a process cartridge is used in an image forming apparatus that uses an electrographic method, such as a copy machine, a laser printer, a facsimile machine and the like. Here, the process cartridge includes an electrographic photosensitive body and various stages including charging, developing and cleaning, together in a cartridge.

Various technologies have been proposed for such a process cartridge. For example, as disclosed in Japanese Laid-Open Patent Application No. H6-180544, a process cartridge installed in a conventional image forming apparatus applies a load torque using a torque application member to control uneven speed of a photosensitive drum.

However, there is a problem that the above-configured process cartridge deforms or warps unless there is a sufficient strength in a frame because a large load applies on the side surface of the frame.

In view of the above-described technical issue, an object of the present invention is to provide a process cartridge that does not apply a load in a side surface direction of the frame when a load torque is applied to a photosensitive drum, thereby preventing deformation, warping and the like of the frame, and an image forming apparatus adapting such a process cartridge. In addition, another object of the present invention is to provide a process cartridge that allows excellent printing without color shift or the like, and an image forming apparatus adapting such a process cartridge. Yet another object of the present invention is to provide a process cartridge that can be securely installed without adding a new member or causing a load member to fall off even if a backlash on the photosensitive drum in an axial direction occurs, and an image forming apparatus adapting such a process cartridge.

SUMMARY

Considering the above objects, a process cartridge according to one embodiment of the invention, which is attachable to and detachable from an image forming device, includes a photosensitive drum that is configured to form an electrostatic latent image, a flange that is arranged to the photosensitive drum, including a cylindrical attachment part, a frame that rotatably holds the flange, and a load member that is slidably press-fitted to the attachment part of the flange. The frame includes an engagement part that is configured to engage with a part of the load member, and a rotation of an end part of the load member is regulated by a regulation surface of the engagement part.

According to the process cartridge and the image forming apparatus of the present invention, the load is not applied on the frame when a load torque is applied to the photosensitive drum, thereby preventing deformation, warping and the like of the frame. In addition, excellent printing is achieved without color shift or the like. Moreover, the process cartridge is securely installed without adding a new member or causing a load member to fall off even if a backlash on the photosensitive drum in an axial direction occurs.

In another view, a process cartridge attachable to and detachable from an image forming device includes a photosensitive drum that is configured to form an electrostatic latent image, a flange that is arranged to the photosensitive drum, including a cylindrical attachment part, a coil-shape load member slidably press-fitted to the attachment part of the flange such that the load member is able to rotate corresponding to a rotation of the flange, a frame that rotatably holds the flange, the frame including an engagement part that is configured to engage with a part of the load member, and a contact including a first contact part and a second contact part, the first contact part being connected to a regulation surface of the engagement part, the second contact part being exposed outside the flame so that the second contact part is connected to a device outside the flame. Wherein, a rotation of an end part of the load member is regulated by the first contact part of the contact, and an electrical connection from the load member to the contact is created through the first contact part.

In another view, a process cartridge attachable to and detachable from an image forming device includes a photosensitive drum that is configured to form an electrostatic latent image, a flange arranged to the photosensitive drum at one end of the photosensitive drum, the flange including a cylindrical attachment part, a load member that is slidably fitted to the attachment part of the flange, and two frames that are provided at both sides of the photosensitive drum with respect to an rotational axis, one frame rotatably holding the flange and including an engagement part that is configured to engage with a part of the load member on an inner surface, the other frame rotatably holding the other end of the photosensitive drum, not including the flange, wherein the load member rotates corresponding to a rotation of the photosensitive drum when a part of the load member does not engage with the engagement part, and the load member does not rotates but the photosensitive drum rotates when the load member engages with the engagement part.

DETAILED DESCRIPTION OF EMBODIMENTS

Preferred embodiments according to a process cartridge and an image forming apparatus of the present embodiments are explained below with reference to the figures. The process cartridge and the image forming apparatus of the present invention are not limited to the below descriptions but may be appropriately modified without departing from the scope of the embodiments.

First Embodiment

Figure 1:
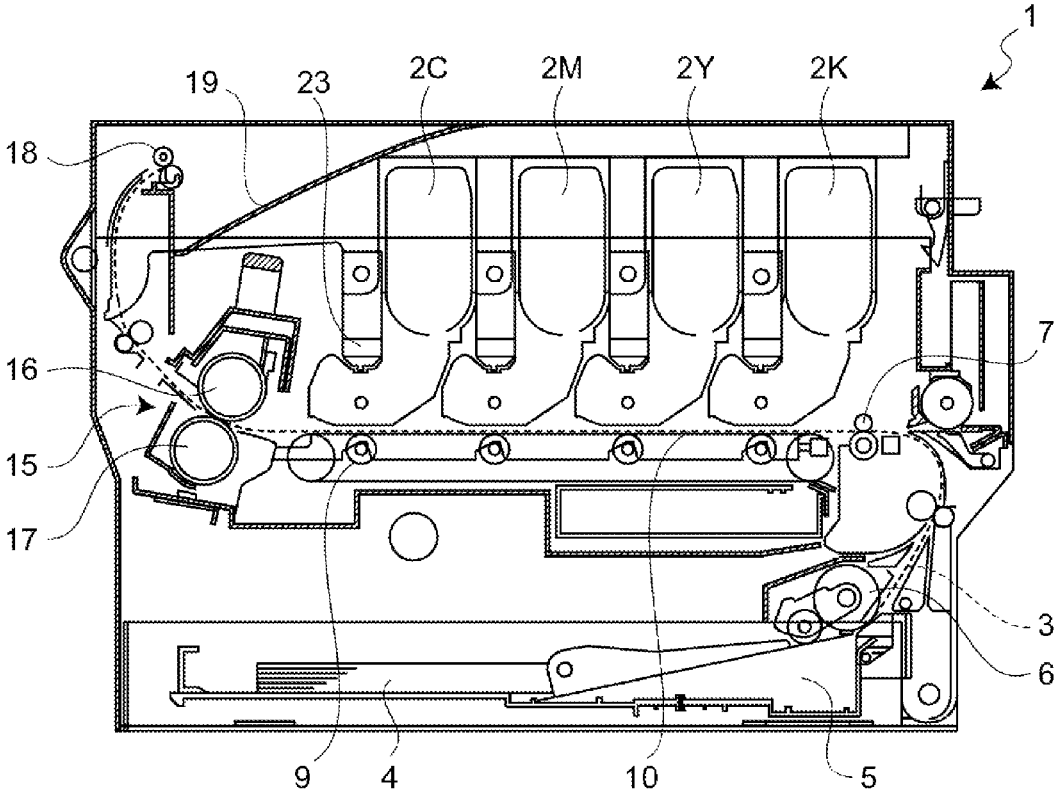
FIG. 1 illustrates a configuration of an image forming apparatus according to a first embodiment of the invention.

FIG. 1 illustrates, for explanation, a configuration of an image forming apparatus 1 according to a first embodiment of the present invention.

As shown in FIG. 1, the image forming apparatus 1 includes process cartridges 2C, 2M, 2Y and 2K that perform printing on a recording medium 4 based on image information that corresponds to the respective colors of CMYK, which are cyan (C), magenta (M), yellow (Y) and black (K). That is, a process cartridge 2 in the image forming apparatus 1 is configured from the process cartridges 2C, 2M, 2Y and 2K that develops the image information that corresponds to each of CMYK. Because these process cartridges 2C, 2M, 2Y and 2K have substantially the same configuration, these process cartridges 2C, 2M, 2Y and 2K are collectively referred to symbol 2 in the blow explanation, and their details are described below.

The image forming apparatus 1 further includes an approximately S-shaped sheet carrying path 3 with a sheet supply cassette 5 as a start point and a stacker 19 to which the recording medium 4, on which the image information that corresponds to CMYK is printed by the process cartridges 2C, 2M, 2Y and 2K provided downstream of the sheet supply cassette 5, is ejected as an end point. That is, the sheet carrying path 3 in the image forming apparatus 1 is configured from the sheet supply cassette 5 that accommodates the recording medium 4 as the start point and the stacker 19 as the end point, via a hopping roller 6, registration rollers 7, a transfer belt 10, a fuser 15 and ejection rollers 18. Each of the configured members and the like that are included in the sheet carrying path 3 is explained in detail below with reference to FIG. 1.

The recording medium 4 is a recording sheet for forming a toner image formed by the process cartridge 2. For example, recording sheets made of paper, plastic films for an over head projector and the like, correspond to the recording medium. However, the recording medium is not limited to these. The sheet supply cassette 5 is a case member in which a plurality of recording media 4 can be accommodated, and is detachable from the image forming apparatus 1. The hopping roller 6 is a member for separating each of the recording media 4 accommodated in the sheet supply cassette 5 and for feeding each recording medium 4 to the sheet carrying path 3. That is, the hopping roller 6 press-contacts the recording media 4 and feeds each recording medium 4. The registration rollers 7 function as carrying rollers for carrying the recording medium 4 separated by the hopping roller 6 without skewing. The transfer belt 10 is an endless belt that sucks and carries the recording medium 4 under a lower part of the process cartridge 2. That is, the transfer belt 10 has a function to carry the recording medium 4, which is a transferred medium that is electrostatically sucked, to an image transfer position of each process cartridge 2.

A light emitting diode (LED) head 23 is an exposure light source configured from a plurality of LED elements, a lens array, a LED driving element and the like. The LED head 23 irradiates light that corresponds to the image information sent from a controller (not shown) on a surface of the later-discussed photosensitive body (e.g., photosensitive drum 21) (later discussed in connection with FIG. 2) to form an electrostatic latent image on the surface of the photosensitive drum 21. That is, the photosensitive drum 21 turns in a state where static electric charge is distributed in a shape of an image by the above-described irradiation of light. The transfer roller 9 is a transfer member for transferring the electrostatic latent image, that is, toner image, formed on the surface of the photosensitive drum 21 to the recording medium 4 and is rotatably provided under the photosensitive drum 21 so as to sandwich the transfer belt 10. That is, the transfer roller 9 has a function to contact and rotate the photosensitive drum 21 via the recording medium 4 and transfer the toner image onto the recording medium 4 by applying a bias that has a reverse polarity from the toner.

The fuser 15 is a unit that fixes the toner image transferred to the recording medium 4 onto the recording medium 4 by using pressure by a fusion roller 16 and a pressure application roller 17 and a heat source, such as a halogen lamp (not shown). In addition, the ejection rollers 18 are rollers that eject, the recording medium 4 on which the toner image has been fixed by the fuser 15, to the stacker 19. The stacker 19 is a space provided on an upper part of the image forming apparatus 1, in which the recording media 4 is stacked.

Next, the process cartridge 2 that prints the toner image on the recording medium 4 based on the image information that corresponds to each of CMYK is further described with reference to FIGS. 2 to 7.

Figure 2:
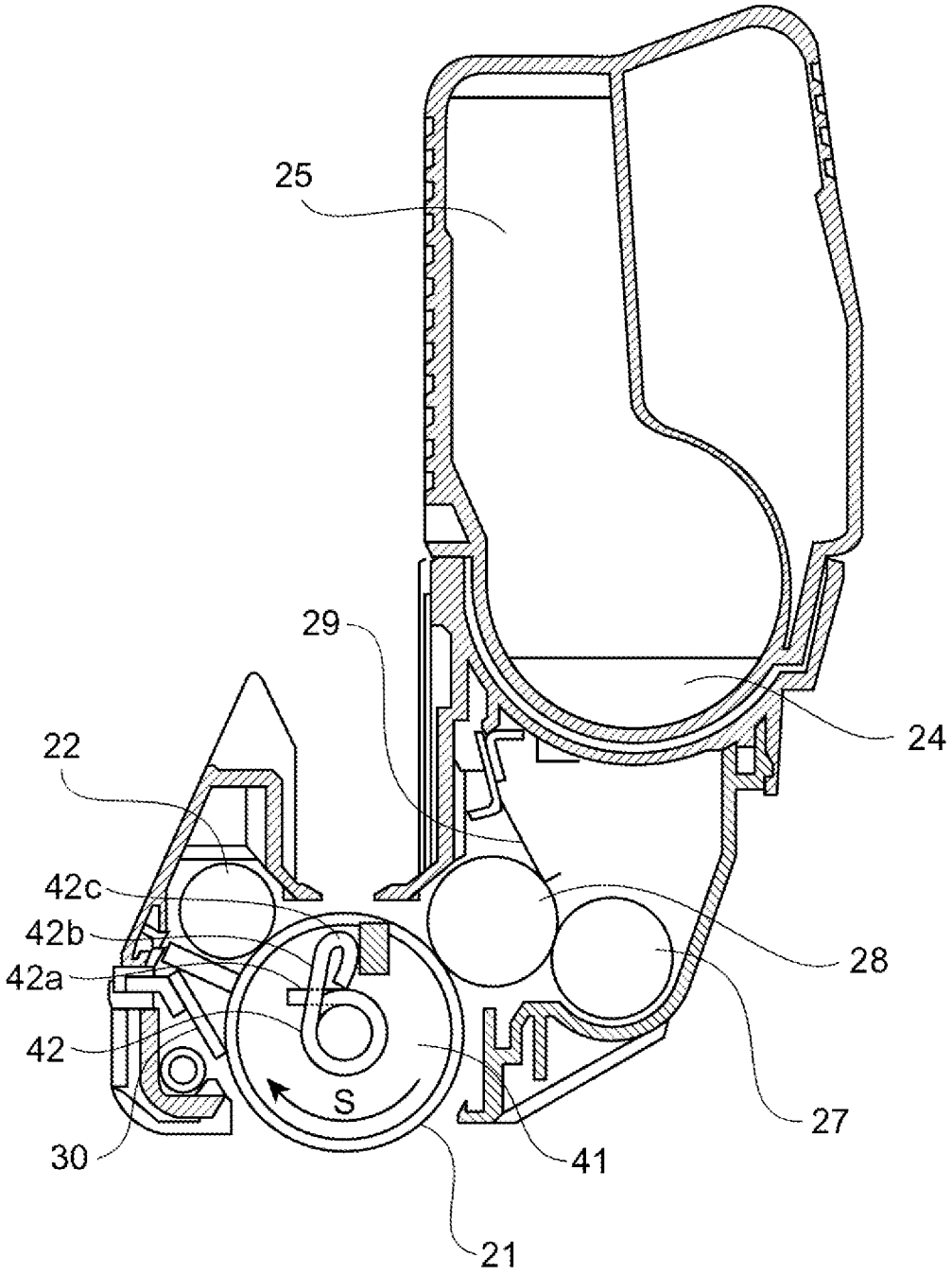
FIG. 2 illustrates a detailed configuration of a process cartridge shown in FIG. 1.
Figure 3:
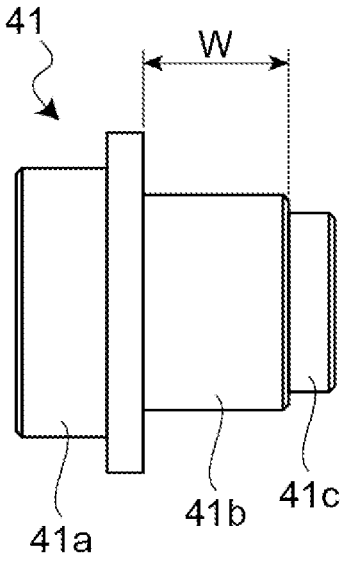
FIG. 3 illustrates a detailed configuration of a flange shown in FIG. 2.
Figure 4:
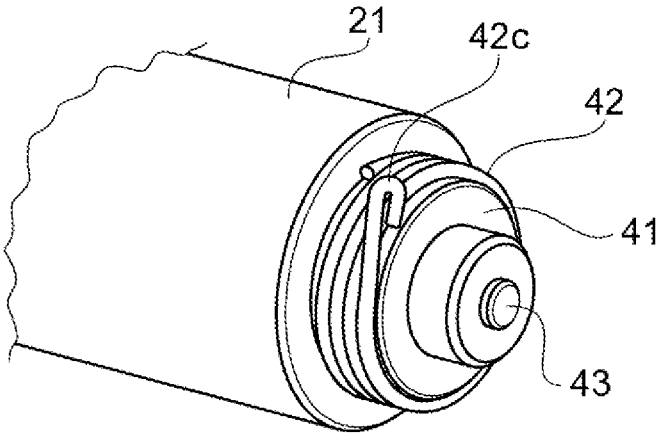
FIG. 4 illustrates the flange mounted on a photosensitive drum and a load member mounted on the flange shown in FIG. 2.
Figure 5:
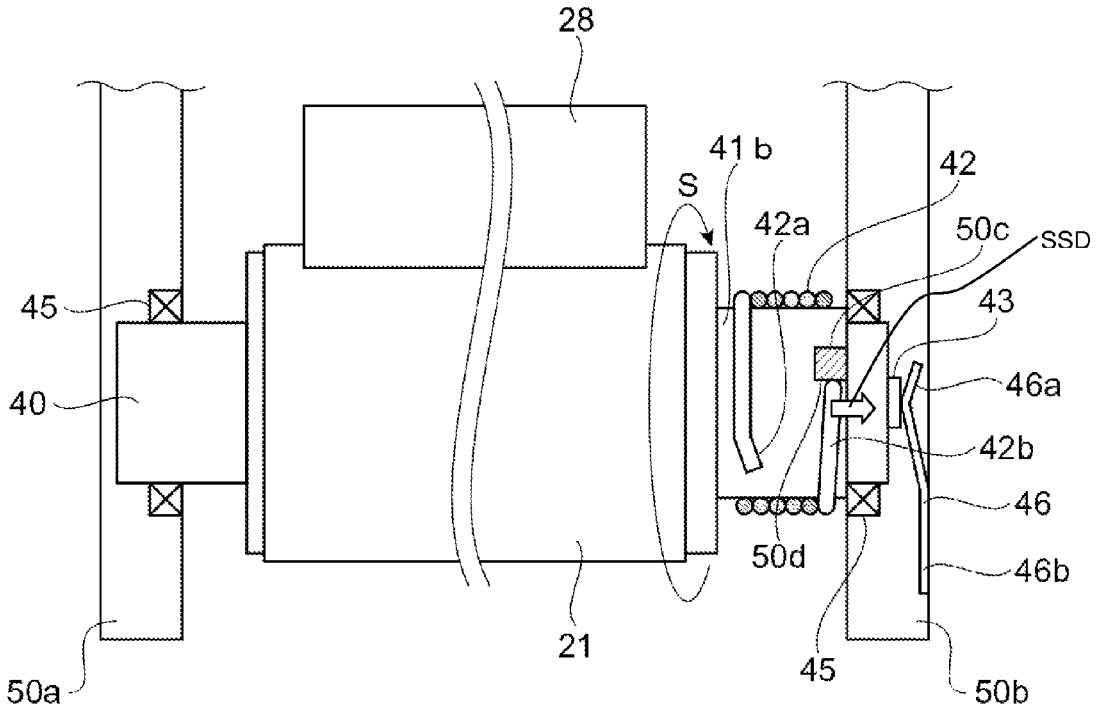
FIG. 5 illustrates in detail a support configuration of the photosensitive drum in the process cartridge shown in FIG. 2.
Figure 6:
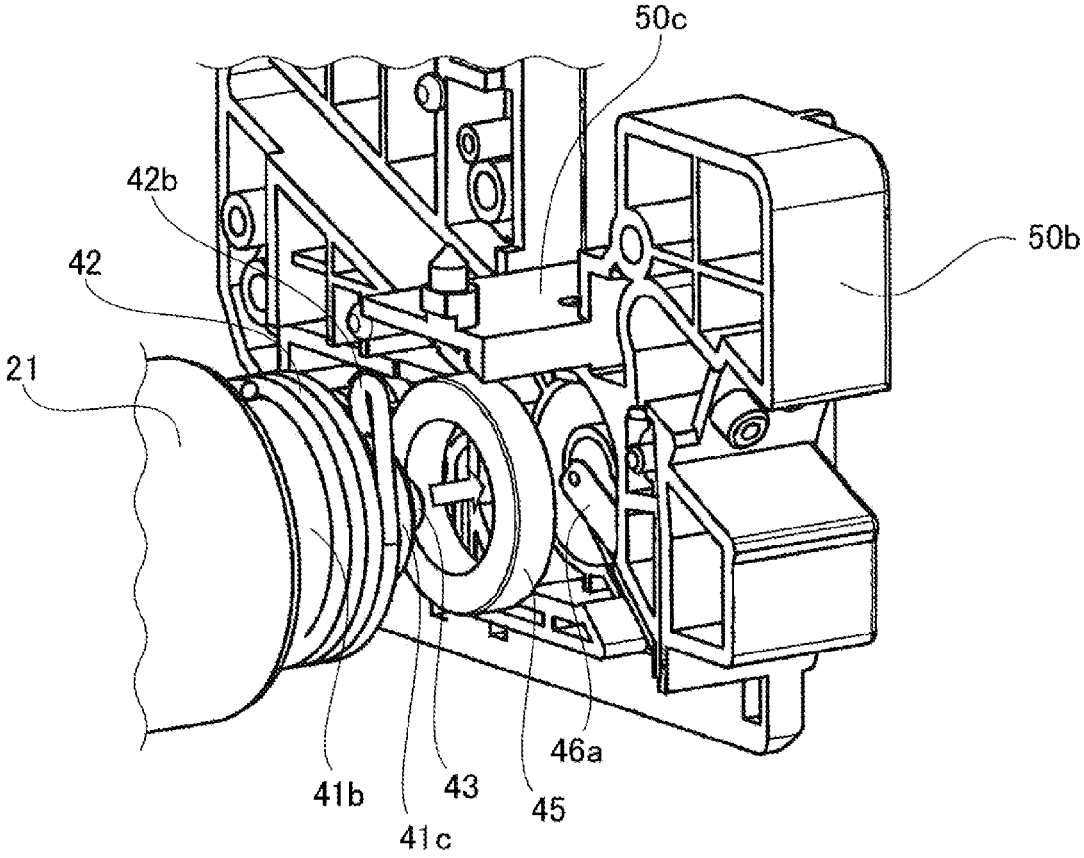
FIG. 6 illustrates a state of the photosensitive drum in the process cartridge shown in FIG. 2 prior to being rotatably supported by a bearing fixed on frames.
Figure 7:
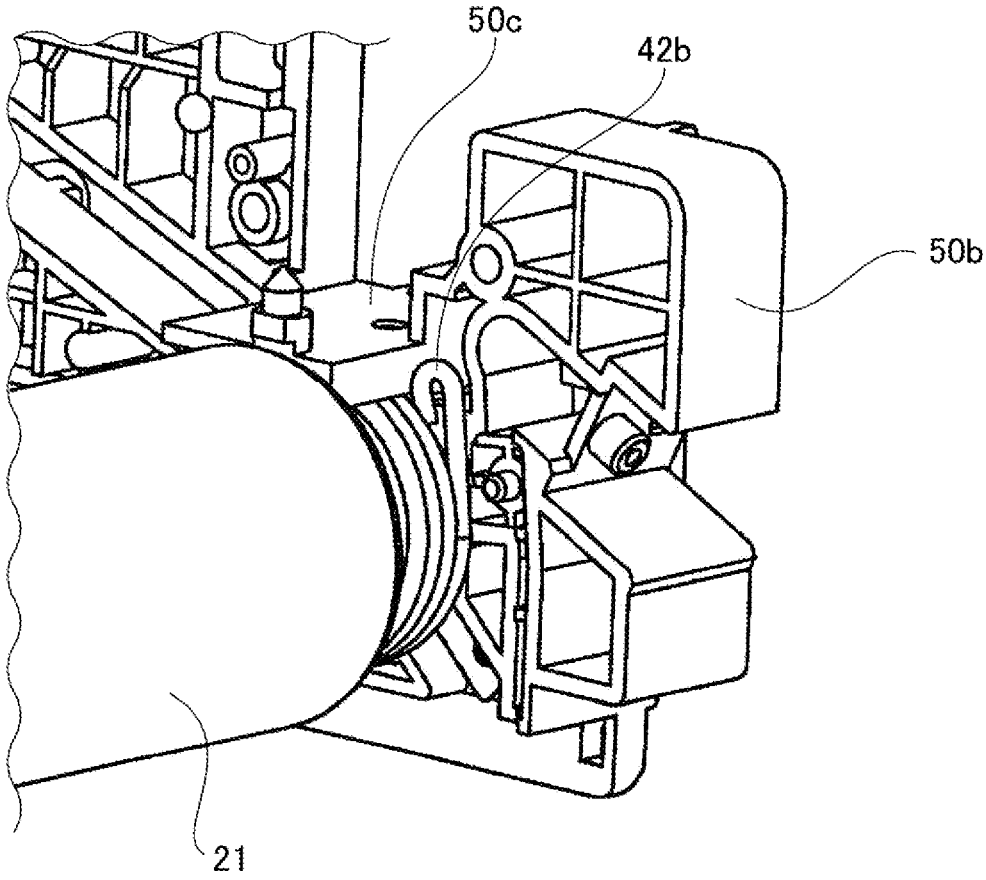
FIG. 7 illustrates a state of the photosensitive drum in the process cartridge shown in FIG. 2 after being rotatably supported by the bearing fixed on the frames.

FIG. 2 illustrates a detailed configuration of the process cartridge 2. FIG. 3 illustrates a detailed configuration of a flange 41. FIG. 4 illustrates the flange 41 mounted on a photosensitive drum 21 and a load member 42 mounted on the flange 41. FIG. 5 illustrates in detail a support configuration of the photosensitive drum 21. FIG. 6 illustrates a state of the photosensitive drum 21 prior to being rotatably supported by a bearing 45 fixed on frames 50*a* and 50*b*. FIG. 7 illustrates a state of the photosensitive drum 21 being rotatably supported by the bearing 45 fixed on the frames 50*a* and 50*b*.

As shown in FIG. 2, the process cartridge 2 includes the photosensitive drum 21 that carries the electrostatic latent image based on the image information that corresponds to one of CMYK, a charging member 22 that causes the surface of the photosensitive drum 21 to hold electric charges, toner 24 that is a developer, a toner cartridge 25 that accommodates the toner 24, a toner supply roller 27 for supplying the toner 24 to a development roller 28, the development roller 28 that develops the electrostatic latent image on the surface of the photosensitive drum 21 with the toner 24, a development blade 29 that regulates a toner layer on the development roller 28 to a constant thickness, and a cleaning blade 30 that scrapes off the toner 24 that remains on the photosensitive drum 21. Although details are discussed later, the flange 41 is attached to the photosensitive drum 21, and the load member 42 is attached to the flange 41. Symbols 42*a*, 42*b* and 42*c* indicate a first arm part, a second arm part and a tip end part, respectively. In addition, a conductive material is used for the load member, and a conductive resin material is used for the flange.

Detailed support configuration of the photosensitive drum 21 is described below with reference to FIGS. 3 to 7.

The flange 41 is a cylindrically shaped member made of a conductive resin material. As shown in FIG. 3, the flange 41 is configured from a fixing part 41*a* that is press-fitted, adhered and fixed to the photosensitive drum 21, an attachment part 41*b* that attaches the later-discussed load member 42, and a support part 41*c* that allows a slidable support. A conductive adhesive is used for the adherence of the fixing part 41*a* to the photosensitive drum 21. Therefore, electric conductivity is secured between the flange 41 and the photosensitive drum 21 after the adherence.

In addition, as shown in FIG. 4, the photosensitive drum 21 is a cylindrically shaped pipe member, in which a photosensitive layer is applied on a conductive base layer made of aluminum. The photosensitive drum 21 and the flange 41 may be referred to as a photosensitive unit.

Then, as shown in FIG. 5, a drive coupling 40 for inputting a drive from the image forming apparatus 1 main body and the flange 41 are fixed on the same axis coaxially fixed on the both end parts of the photosensitive drum 21. The drive coupling 40 and the flange 41 are rotatably supported by the bearing 45 fixed to the frames 50*a* and 50*b*. The frames 50*a* and 50*b* are provided orthogonal to the longitudinal direction of the photosensitive drum 21. A hook part 50*c* is an engagement part that is provided on a side surface of the frame 50*b* on the photosensitive drum 21 side and engages with a part of the load member 42. The hook part 50*c* includes a regulation surface 50*d* for regulating rotation of the load member 42. In this embodiment, the engagement part is realized as the hook part 50*c* having a protrusion shape that protrudes from the side surface of the frame 50*b*. However, the engagement part may be realized with an indentation shaped (or cavity shaped) part in which an end of the load member 42 is inserted. Further, as long as the engagement part functions to regulate a movement of the photosensitive drum, there is no limitation regarding the structure, shape or material of the engagement part. An angle formed by the regulation surface 50*d* and a surface of the frame 50*b* on the photosensitive drum 21 side and an upstream side of the rotation is approximately perpendicular with each other. That is, the regulation surface 50*d* of the hook part 50*c*, which is in the protrusion shape, is approximately perpendicular to a rotation direction of the photosensitive drum 21.

A central contact part 43 is a protruding shape part provided on a center shaft of the flange 41 and is formed so as to protrude towards outside of the photosensitive drum 21. A contact 46 is a copper plate member for conductivity and is fixed on the frame 50*b* such that a first contact part 46*a* of the contact 46 is exposed on the photosensitive drum 21 side and that a second contact part 46*b* of the contact 46 is exposed outside the process cartridge 2. The first contact part 46*a* is configured to always elastically contact the central contact part 43. The second contact part 46*b* is configured to contact a flame ground (FG) terminal of the image forming apparatus 1 main body (not shown) when the process cartridge 2 is installed in the image forming apparatus 1. Therefore, the photosensitive drum 21 is grounded via the FG terminal of the image forming apparatus 1 through an electric resistance of the flange 41.

The load member 42 is a stainless load application member for applying a load torque when the photosensitive drum 21 rotates. As shown in FIG. 4, the load member 42 has a coil shape and is slidably press-fit in the attachment part 41*b* of the flange 41. The photosensitive drum 21 receives a rotational force from a drive source provided on the image forming apparatus 1 main body (not shown) via the drive coupling 40. At that time, a rotational vibration caused by backlash of the coupling part may be generated, resulting in a defect on the image. By attaching the load member 42, the vibration of the photosensitive drum 21 is suppressed.

A sliding width regarding the load member 42 and the flange 41 is narrower than a width W (see FIG. 3) of the attachment part 41*b* of the flange 41 so that a load is not applied to the photosensitive drum 21 and the side surface of the frame 50*b*. In the invention, the sliding width is defined, for example, as a width of a region where the load member 42 contacts the outer surface of flange 41 in the axis direction of the flange 41. The width W of the attachment part 41*b* is defined along with the rotational axis of the photosensitive drum. In addition, both end parts of the load member 42 extend in tangential directions with respect to the respective winding outer diameter and form the first arm part 42*a* and the second arm part 42*b*, respectively. The first arm part 42*a*, which is provided on the photosensitive drum 21 side as attached to the attachment part 41*b* of the flange 41, is bent in the direction of the frame 50*b* such that the tip end part does not hook on the side surface of the attachment part 41*b*. Moreover, the tip end part of the second arm part 42*b* of the load member 42 forms the tip end part 42*c* (see FIG. 4) by being bent in the same direction as the winding direction. The load member 42 is wound in a direction in which a force, by which the coil shape of the load member 42 expands, applies when the load member 42 rotates in an arrow S direction (see FIG. 5) of the photosensitive drum 21 and when the tip end part 42*c* contacts the regulation surface 50*d* of the hook part 50*c*.

(Dimensions of Load member and Flange)

The inner diameter of coil shaped load member 42 is slightly smaller than the outer diameter of the flange 41. With the configuration, the load member 42 is allowed to rotate within the flange 41, but a friction force, which works in an opposite direction from the rotation S, is created on the surfaces between the flange 41 and the load member 42. Thanks to the support by the load member 42, a vibration of the photosensitive drum is suppressed through the flange. The proper gap between the inner diameter of load member 42 and the outer diameter of the flange 41 is determined in order to obtain a sufficient friction force by considering materials, friction coefficient, surface shapes, contact area between the load member and the flange etc. For the materials, resin, rubber, and wood as well as metal are available. To enhance or reduce the friction force, magnetic materials also are available.

Further, as a modification, the load member 42 may be arranged inside a flange having a hole. In the modification, an outer diameter of the load member is equal to or larger than an inner diameter of the hole of the flange.

Operation by the above-described configuration is explained below in detail.

First, when a power source (not shown) is turned on, a controller (not shown) of the image forming apparatus 1 performs a predetermined initialization operation and places the image forming apparatus 1 in a standby state. Then, when a print instruction is sent from a host computer (not shown) as a host device to the image forming apparatus 1, each recording medium 4 is fed from the sheet supply cassette 5 by the hopping roller 6. The recording medium 4 that has been fed passes through the sheet carrying path 3 and is carried by the registration rollers 7. Then the recording medium 4 is electrostatically sucked by the transfer belt 10 and sent between the process cartridges 2K, 2Y, 2M and 2C and their respective transfer rollers 9.

At the same time, in each of the process cartridges 2K, 2Y, 2M and 2C, the charging roller 22, the supply roller 27, the development roller 28 and the development blade 29 receives a predetermined negative voltage from the power source part (not shown) and starts being driven by a drive source (also not shown).

As a result, electric charges are injected to the photosensitive drum 21 by an action of the charging roller 22, and therefore, the surface is uniformly charged with a predetermined negative potential. When an image that corresponds to the print instruction is exposed on the surface by the LED head 23, the electric charges at the exposed part flows out to the device main body of the photosensitive drum 21 through the flange 41 and the contact 46. Therefore, the charged part turns into a highly charged state in which a potential is higher than the above-discussed predetermined negative potential. As a result, an electrostatic latent image is formed. That is, the photosensitive drum 21 turns into a state in which electrostatic charges are distributed in a shape of the image by the radiation of the light of the LED head 23.

In the meantime, the supply roller 27 supplies the toner 24 to the development roller 28. The development blade 29 regulates the toner on the development roller 28 at an appropriate thickness. Then, the regulated toner on the development roller 28 develops a toner image on the electrostatic latent image on the photosensitive drum 21.

At this time, in the image forming apparatus 1 main body, the recording medium 4 carried by the registration rollers 7 is electrostatically sucked on the transfer belt 10 by the electrostatics. As the recording medium 4 is carried to each of the process cartridges 2K, 2Y, 2M, 2C along the traveling of the transfer belt 10, toner images formed on the respective photosensitive drums 21 are sequentially transferred onto the recording medium 4 by the respective transfer rollers 9 to form a color toner image. The toner that is not transferred onto the recording medium 4 and that remains on the photosensitive drum 21 is scraped off by the cleaning blade 30 in each process cartridge 2.

The recording medium 4 on which the color toner image has been formed is sent to the fuser 15. The color toner image is fixed on the recording medium 4 by being heated and pressed by the pressure application roller 17 and the fusion roller 16 that has been heated to a predetermined temperature by a heat source (not shown). Thereby, an image is formed on the recording medium 4. Next, the recording medium 4 on which the image has been formed is further carried by the ejection rollers 18 and is ejected to the stacker 19. A series of print operations is so ended.

Here, details of the operation around the photosensitive drum 21 and the load member 42 at the time of the above-described series of print operations by the image forming apparatus 1 according to the present embodiment are described.

First, when the photosensitive drum 21 starts rotating in the arrow s direction (see FIG. 5), the load member 42 that has been slidably press-fit on the attachment part 41*b* of the flange 41 attempts to rotate together in the same direction (i.e., arrow s direction). However, because the tip end part 42*c* provided at the frame 50*b* side end part of the load member 42 hits the regulation surface 50*d* of the hook part 50*c* provided on the frame 50*b*, the rotation of the load member 42 is regulated, and only the photosensitive drum 21 and the flange 41 continues to rotate. If the load member 42 does not engage with the hook part 50*c*, the load member 42 is able to rotate corresponding to the flange. At this time, as discussed above, because the load member 42 is press-fitted to the attachment part 41*b* of the flange 41, the photosensitive drum 21 continues to rotate while receiving a constant load torque due to a frictional force by the load member 42. The direction of the load torque is an opposite direction from the rotation of the photosensitive drum 21.

The regulation surface 50*d* of the hook part 50*c* on which the tip end part 42*c* of the load member 42 hits is approximately perpendicular to the rotational direction of the photosensitive drum 21 and the frame 50*b*. Therefore, a load by the load member 42 in a side surface direction does not apply on the frame 50*b*. Only for the explanation purpose, arrow SSD indicating the side surface direction is illustrated in FIG. 5. It is noted that arrow SSD does not intend any load along the direction.

As explained above, according to the first embodiment of the present invention, the process cartridge 2 attachable to and detachable from the image forming device 1 is provided. The process cartridge 2 includes the photosensitive drum 21 that is configured to form an electrostatic latent image, the flange 41 that is arranged to the photosensitive drum 21, including the cylindrical attachment part, the frame 50*b* that rotatably holds the flange 41, and the load member 42 that is slidably press-fitted to the attachment part 41*b* of the flange 41 such that the load member 42 is able to rotate corresponding to a rotation of the flange 41, wherein the frame 50*b* includes the hook part 50*c* as the engagement part that is configured to be protruded toward the photosensitive drum 21 side in the axis direction of the photosensitive drum 21 and to engage with a part of the load member 42, and a rotation of an end part of the load member 42 is regulated by the regulation surface 50*d* of the engagement part. Additionally, the above flange 41 is fixed to the photosensitive drum 21 according to the embodiment. However, the flange may be a separate part from the photosensitive drum and attached to the photosensitive drum 21.

Here, the sliding width of the load member 42 and the flange 41 may be narrower than a width of the attachment part 41*b* of the flange. Further, the regulation surface 50*d* of the hook part 50*c* as the engagement part may be approximately perpendicular to a rotational direction of the photosensitive drum 21. Furthermore, the load member 42 may be made of a conductive material, also, the flange 41 may be made of a conductive resin material.

Therefore, according to the first embodiment of the invention, a load does not apply in the side surface direction of the frame 50*b* when a load torque is applied to the photosensitive drum 21. Therefore, deformation, warping or the like does not occur to the frame 50*b*, and thereby, excellent printing without color shift is possible.

Second Embodiment

A process cartridge and an image forming apparatus according to a second embodiment only has a difference in a support configuration for the photosensitive drum 21 in the process cartridge 2 compared to the first embodiment. Therefore, only this point is explained with reference to FIGS. 8 to 10. Components that are the same as the first embodiment are indicated with the same symbols, and duplicative explanations are omitted.

Figure 8:
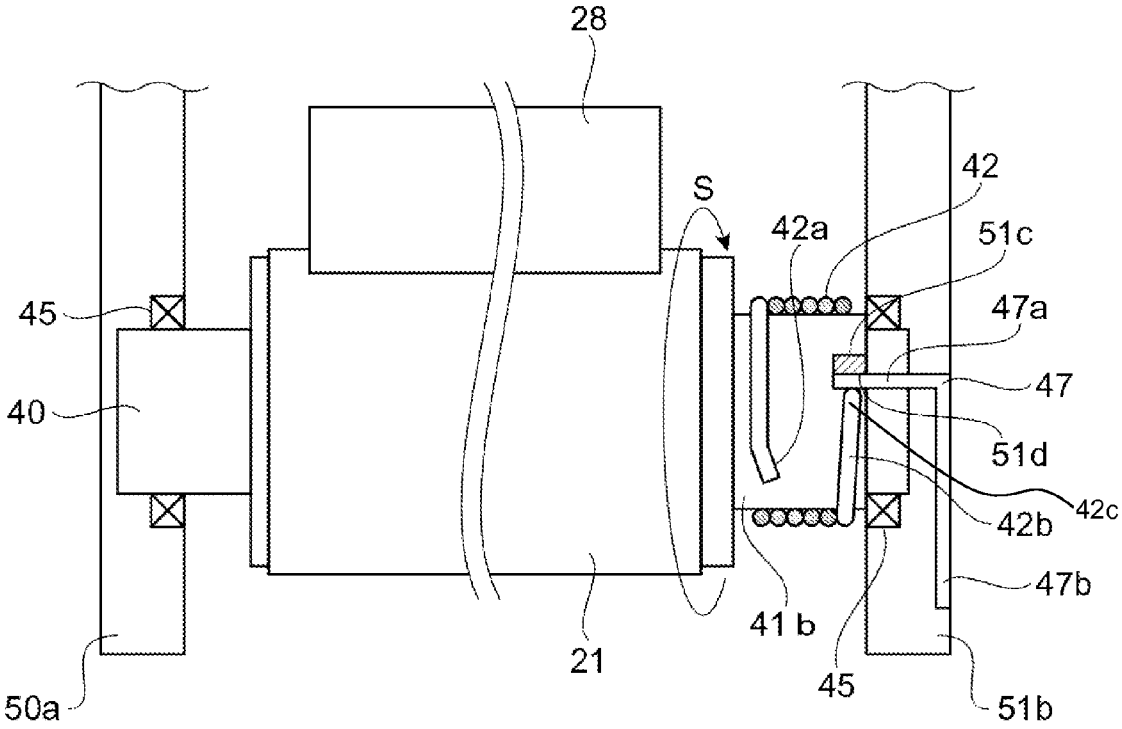
FIG. 8 illustrates in detail a support configuration of the photosensitive drum in the process cartridge according to a second embodiment of the present invention.
Figure 9:
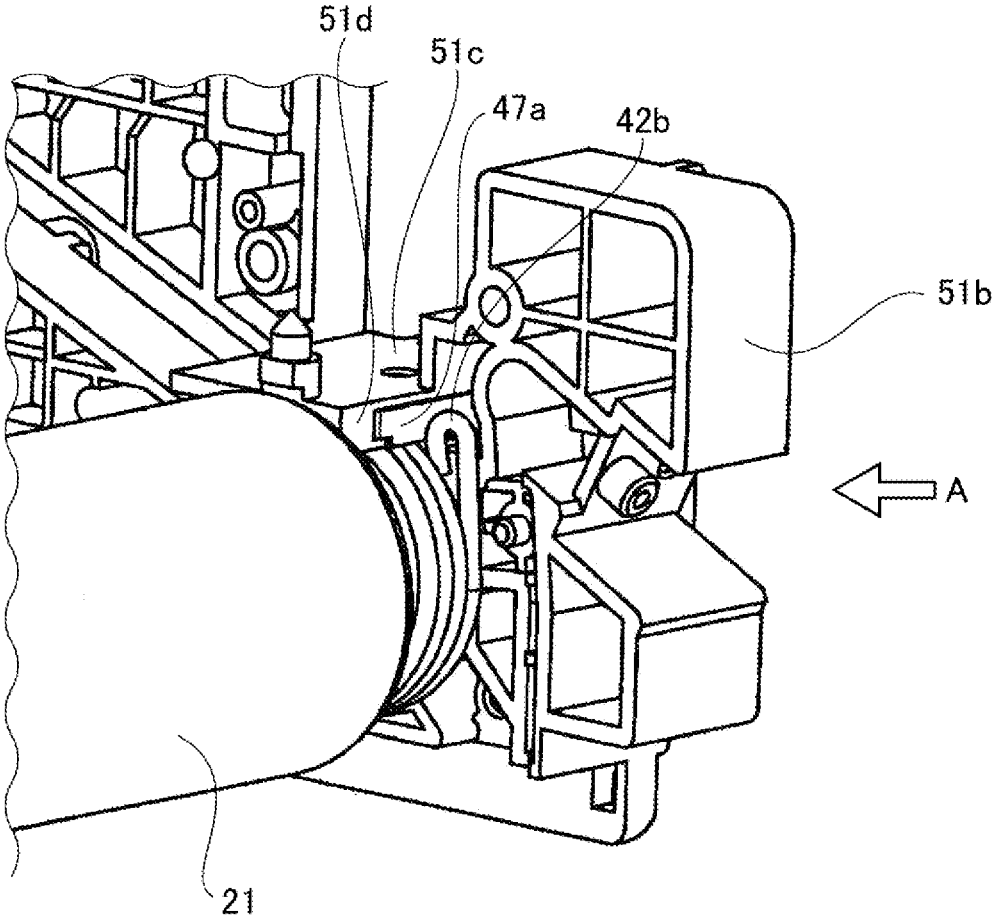
FIG. 9 illustrates a state of the photosensitive drum in the process cartridge shown in FIG. 8 after being rotatably supported by the bearing fixed on the frames.
Figure 10:
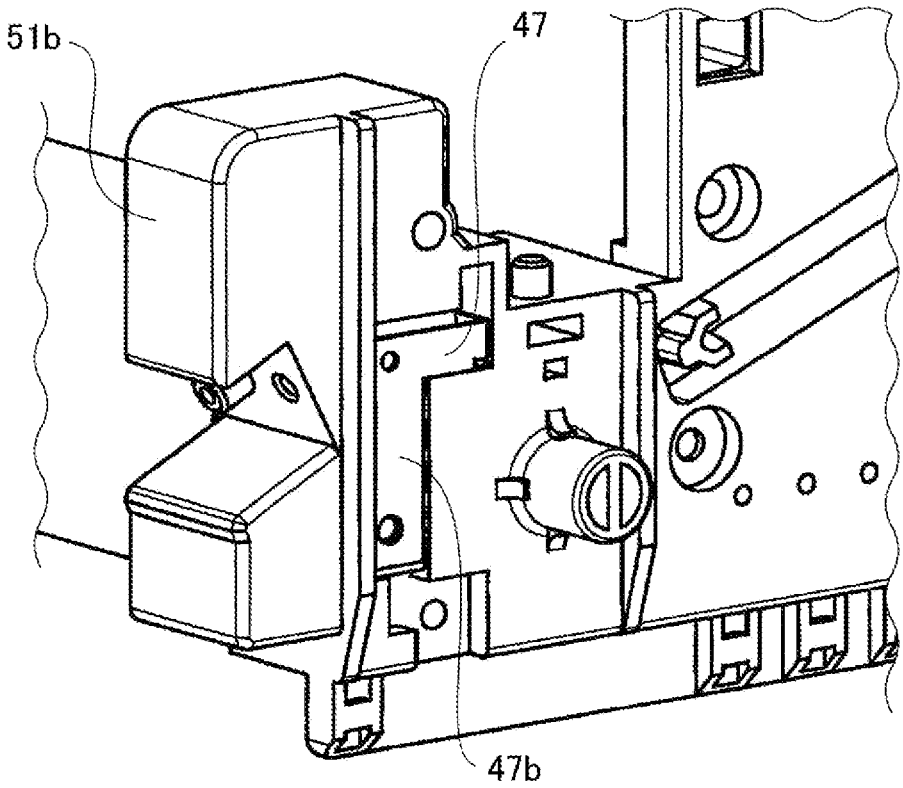
FIG. 10 is a perspective view in a direction A shown in FIG. 9.

FIG. 8 illustrates in detail a support configuration of the photosensitive drum 21. FIG. 9 illustrates a state of the photosensitive drum 21 being rotatably supported by the bearing 45 fixed on the frames 50*a* and 51*b*. FIG. 10 is a perspective view in a direction A shown in FIG. 9.

As shown in FIG. 8, the drive coupling 40 and the flange 41 fixed to end parts of the photosensitive drum 21 are slidably supported by the bearing 45 fixed to the frames 50*a* and 51*b*. A hook part 51*c* is an engagement part that is provided on a side surface of the frame 51*b* on the photosensitive drum 21 side and engages with a part of the load member 42. The side on which the engagement part is provided is an inner side (inner surface) of the frame 51*b*. The hook part 51*c* includes a regulation surface 51*d* for regulating rotation of the load member 42. The engagement part has a protrusion shape in the below explanation. However, the engagement part may have an indentation shape in which an end of the load member 42 is inserted. An angle formed by the regulation surface 51*d* and a side surface of the frame 51*b* on the photosensitive drum 21 side and an upstream side of the rotation is approximately perpendicular with each other. That is, the regulation surface 51*d* of the hook part 51*c*, which is a protrusion part, is approximately perpendicular to a rotation direction of the photosensitive drum 21.

In addition, conductive grease is applied to the attachment part (41*b*) of the flange 41 to assist electrical connection with the load member 42.

A contact 47 is a copper plate member for conductivity and is fixed on the frame 51*b* such that a first contact part 47*a* is exposed on the photosensitive drum 21 side and that a second contact part 47*b* is exposed outside the process cartridge 2 (see FIG. 10). The first contact part 47*a* is provided along the regulation surface 51*d* of the hook part 51*c*. Therefore, an angle formed by the first contact part 47*a* of the contact 47 and a side surface of the frame 51*b* on the photosensitive drum 21 side and an upstream side of the rotation is approximately perpendicular with each other. That is, the connectable contact 47 is provided on a contact surface (or regulation surface) of the hook part 51*c* so as to be exposed outside.

As the only difference in the image forming apparatus according to the second embodiment is the operation around the photosensitive drum 21 and the load member 42 compared with the above-discussed first embodiment, only the difference is explained below.

First, when the photosensitive drum 21 starts rotating in the arrow s direction (see FIG. 8), the load member 42 that has been slidably press-fit on the attachment part 41*b* of the flange 41 attempts to rotate together in the same direction (i.e., arrow s direction). However, because the tip end part 42*c* of the load member 42 hits the contact part 47*a* provided along the regulation surface 51*d*, the rotation of the load member 42 is regulated at this location, and only the photosensitive drum 21 and the flange 41 continues to rotate. At this time, a force by a frictional force between the attachment part 41*b* and the load member 42 is generated at the tip end part 42*c* of the load member 42. Therefore, the electrical connection between the load member 42 and the contact 47 is secured as the force becomes a contact force against the contact 47.

Moreover, the load member 42 does not lose an electric resistance as the load member 42 is press-fitted to the attachment part 41*b* of the flange 41 and as there is assistance by the conductive grease applied on the attachment part 41*b*. Therefore, the accumulated electric charges flow accurately to the apparatus main body when the electrostatic latent image is formed.

As explained above, according to the second embodiment of the present invention, a process cartridge attachable to and detachable from an image forming device includes the photosensitive drum 21 that is configured to form an electrostatic latent image, the flange 41 that is arranged to the photosensitive drum 21, including the cylindrical attachment part, the coil-shape load member 42 slidably press-fitted to the attachment part 41*b* of the flange 41 such that the load member 42 is able to rotate corresponding to a rotation of the flange 41, the frame 51*b* that rotatably holds the flange 41, the frame 41 including the hook part 51*c* as the engagement part that is configured to engage with a part of the load member 42, and the contact 47 including the first contact part 47*a* and the second contact part 47*b*. The first contact part 47*a* (or regulation surface) is connected to the regulation surface 51*d* of the hook part 51*c*, the second contact part 47*b* is exposed outside the flame 51*b* so that the second contact part 47*b* is connected to a device outside the flame 51*b*. Wherein a rotation of an end part of the load member 42 is regulated by the first contact part 47*a* of the contact 47, and an electrical connection from the load member 42 to the contact 47 is created through the first contact part.

Therefore, according to the second embodiment of the invention, the electrical connection of the photosensitive drum 21 to the FG is secured without adding a new member even if backlash occurs on the photosensitive drum 21 in the axial direction.

Third Embodiment

A process cartridge and an image forming apparatus according to a third embodiment only has a difference in a support configuration for the photosensitive drum 21 in the process cartridge 2 compared to the second embodiment. Therefore, only this point is explained with reference to FIGS. 11 to 13. Components that are the same as the second embodiment are indicated with the same symbols, and duplicative explanations are omitted.

Figure 11:
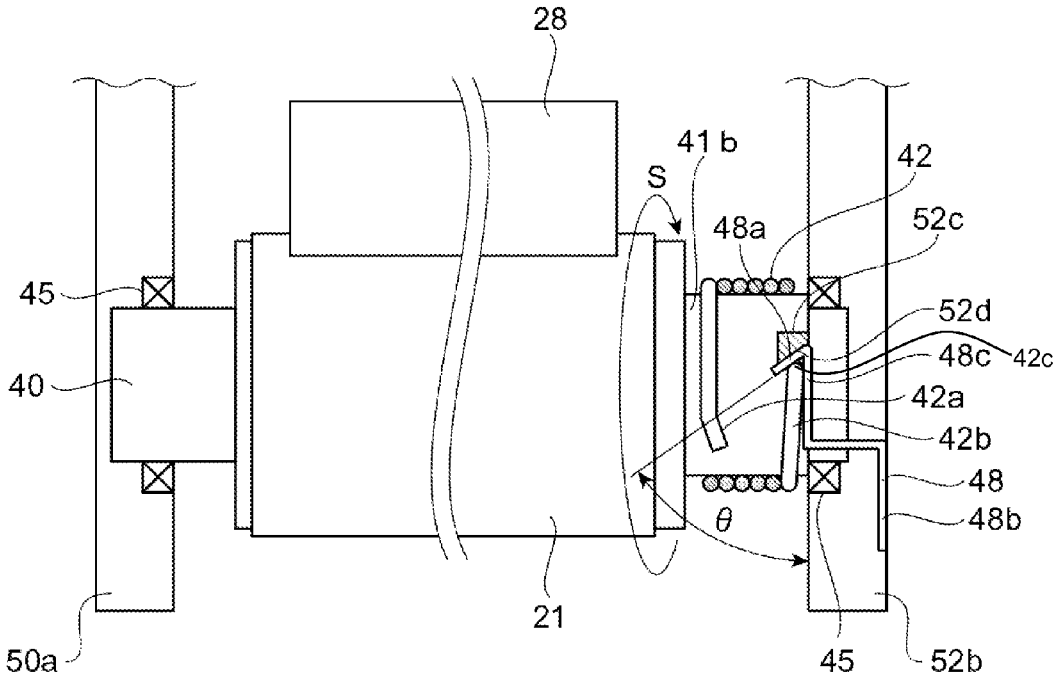
FIG. 11 illustrates in detail a support configuration of the photosensitive drum in the process cartridge according to a third embodiment of the present invention.
Figure 12:
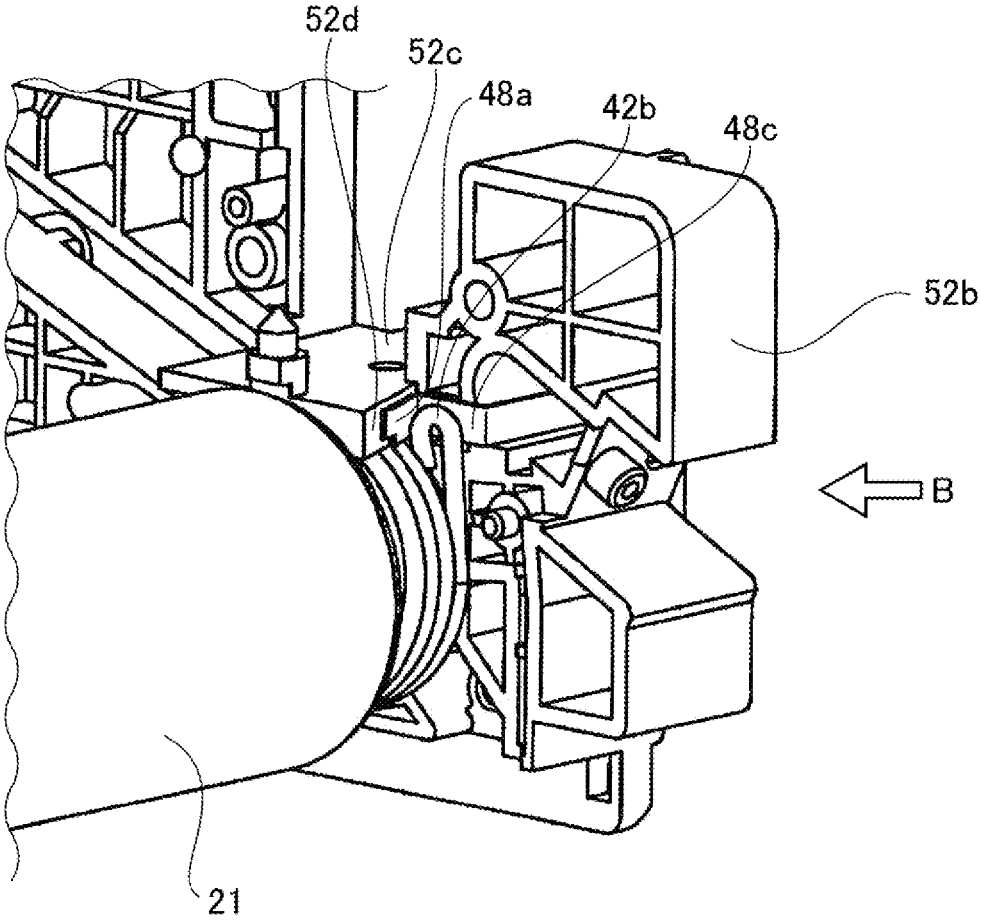
FIG. 12 illustrates a state of the photosensitive drum in the process cartridge shown in FIG. 11 after being rotatably supported by the bearing fixed on frames.
Figure 13:
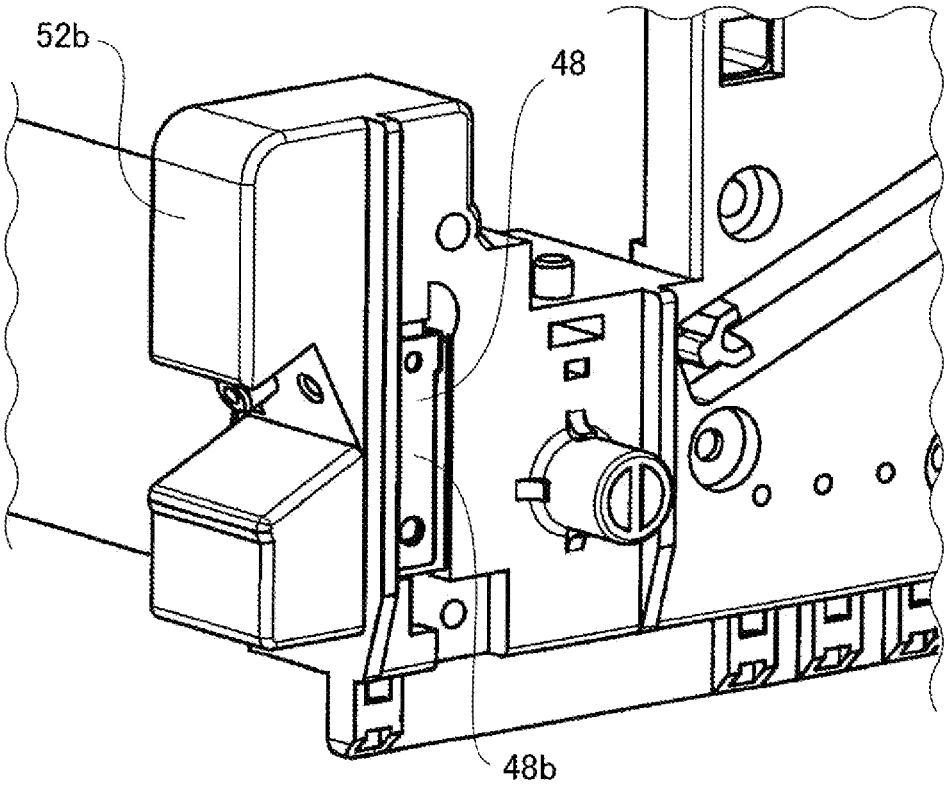
FIG. 13 is a perspective view in a direction B shown in FIG. 12.

FIG. 11 illustrates in detail a support configuration of the photosensitive drum 21. FIG. 12 illustrates a state of the photosensitive drum 21 being rotatably supported by the bearing 45 fixed on the frames 50*a* and 52*b*. FIG. 13 is a perspective view in a direction B shown in FIG. 12.

The drive coupling 40 and the flange 41 that are fixed to end parts of the photosensitive drum 21 are slidably supported by the bearing 45 fixed to the frames 50*a* and 52*b*. The frames 50*a* and 52*b* are provided orthogonal to the photosensitive drum 21.

A hook part 52*c* is an engagement part that is provided on the frame 52*b* and engages with a part of the load member 42. The hook part 52*c* includes a regulation surface 52*d* for regulating rotation of the load member 42. The engagement part has a protrusion shape in the below explanation. However, the engagement part may have an indentation shape in which an end of the load member 42 is inserted. An angle formed by the regulation surface 52*d* and a side surface of the frame 52*b* on the photosensitive drum 21 side and an upstream side of the rotation is approximately perpendicular with each other. That is, the regulation surface 52*d* of the hook part 52*c* is approximately perpendicular to a rotation direction of the photosensitive drum 21.

A contact 48 is a copper plate member for conductivity and is fixed on the frame 52*b* such that a first contact part 48*a* is exposed on the photosensitive drum 21 side and that a second contact part 48*b* is exposed outside the process cartridge 2. The first contact part 48*a* of the contact 48 is provided along the regulation surface 52*d*. Therefore, an angle θ (see FIG. 11) formed by the first contact part 48*a* of the contact 48 and a side surface on the photosensitive drum 21 side and an upstream side of the rotation is an acute angle. That is, an angle formed by the regulation surface 52*d* of the hook part 52*c* and the surface forming the hook part 52*c* of the frame 52*b* is an acute angle. In the present embodiment, the connectable contact 48 that is exposed outside is provided on the regulation surface 52*d* of the hook part 52*c* and the surface of the frame 52*b* on which the hook part 52*c* is formed.

As the only difference is the operation around the photosensitive drum 21 and the load member 42 compared with the above-discussed first and second embodiments, only the difference is explained below.

First, when the photosensitive drum 21 starts rotating in the arrow s direction (see FIG. 11), the load member 42 that has been slidably press-fit on the attachment part 41*b* of the flange 41 attempts to rotate together with the photosensitive drum 21 in the same direction. However, because the tip end part 42*c* of the load member 42 hits the contact part 48*a* of the contact 48 provided along the regulation surface 52*d* of the hook part 52*c*, the rotation of the load member 42 is regulated at this location, and only the photosensitive drum 21 and the flange 41 continues to rotate. At this time, a force by a frictional force between the attachment part 41*b* of the flange 41 and the load member 42 is generated at the tip end part 42*c* of the load member 42. Therefore, the electric connection between the load member 42 and the contact 48 is secured as the force becomes a contact force against the contact 48.

In addition, the tip end part 42*c* of the load member 42 is unlikely dislocated from the hook part 52*c* as a force is applied outwardly in the axial direction of the photosensitive drum 21 due to the regulation surface having the inclided surface with respect to the axis once the tip end part 42*c* contacts the contact part 48*a* of the contact 48. Moreover, because the tip end part 42*c* contacts the part 48*c* (third contact part) of the contact 48 on the side of the side surface of the frame 52*b*, the electrical connection between the load member 42 and the contact 48 is further secured.

As explained above, according to the third embodiment of the present invention, the process cartridge 2 attachable to and detachable from the image forming device 1 includes the photosensitive drum 21 that is configured to form an electrostatic latent image, the flange 41 that is arranged to the photosensitive drum 21, including the cylindrical attachment part, the coil-shape load member 42 slidably press-fitted to the attachment part 41*b* of the flange 41 such that the load member 42 is able to rotate corresponding to a rotation of the flange 41, the frame 51*b* that rotatably holds the flange 41, the frame 51*b* including the hook part 51*c* as the engagement part that is configured to engage with a part of the load member 42, and the contact 47 including the first contact part 47*a* and the second contact part 47*b*. The first contact part 47*a* (or regulation surface) is connected to the regulation surface 51*d* of the hook part 51*c*, the second contact part 47*b* is exposed outside the flame 51*b* so that the second contact part 47*b* is connected to a device outside the flame 51*b*. Wherein, a rotation of an end part of the load member 42 is regulated by the first contact part 47*a* of the contact 47, and an electrical connection from the load member 42 to the contact 47 is created through the first contact part 47*a*.

Therefore, according to the third embodiment of the present invention, the load member 42 is securely installed without falling off even if a backlash occurs on the photosensitive drum 21 in the axial direction. Moreover, the electrical connection of the photosensitive drum 21 to the FG is secured.

The first to third embodiments of the present invention are explained above. However, the present invention is not limited to these embodiments, but various improvements and/or modifications are possible without departing its intended purpose. For example, the present embodiments may of course be applied in photocopy machines, printers, facsimile machines and the like that includes a detachable print process cartridge(s).

What is claimed is:

1. A process cartridge attachable to and detachable from an image forming device, the process cartridge comprising:

a photosensitive unit that rotates about a rotational axis, the photosensitive unit including:

a photosensitive drum that is configured to form an electrostatic latent image and that includes an edge part; and a flange that is positioned outside the edge part of the photosensitive drum in a rotational axis direction of the photosensitive unit, including a cylindrical attachment part;

a frame that rotatably holds a part of the photosensitive unit; and a load member that is slidably press-fitted to the attachment part of the flange, wherein the frame includes an engagement part that is configured to engage with a part of the load member, a rotation of an end part of the load member is regulated by a regulation surface of the engagement part, and the load member is positioned entirely outside the edge part of the photosensitive drum in the rotational axis direction of the photosensitive unit.

2. The process cartridge of claim 1, wherein the engagement part has a shape protruding in the rotational axis direction of the photosensitive unit from the frame toward the photosensitive drum.

3. The process cartridge of claim 1, wherein a sliding width of the load member and the flange is narrower than a width of the attachment part of the flange, the sliding width and the width of the attachment being defined along with the rotational axis of the photosensitive unit.

4. The process cartridge of claim 1, wherein the regulation surface of the engagement part is approximately perpendicular to a rotational direction of the photosensitive unit.

5. The process cartridge of claim 1, wherein the load member is made of a conductive material.

6. The process cartridge of claim 1, wherein the flange is made of a conductive resin material.

7. The process cartridge of claim 1, wherein a contact is provided on the regulation surface of the engagement part, the contact being exposed outside and connectable with the load member.

8. The process cartridge of claim 1, wherein an angle formed by the regulation surface of the engagement part and a surface on which the engagement part is formed is an acute angle.

9. The process cartridge of claim 1, further comprising:

a contact that contacts the regulation surface of the engagement part and a surface on which the engagement part is formed, wherein a part of the contact is exposed outside the frame.

10. The process cartridge of claim 1, wherein the load member has a coil shape, and an inner diameter of the load member is equal to or smaller than an outer diameter of the flange such that the load member holds the flange but the flange is rotatable in the load member.

11. An image forming apparatus, comprising:

the process cartridge of claim 1;

a transfer part that is provided adjacent to the process cartridge; and a fuser that is provided in a downstream side of the process cartridge along a medium carrying direction.

12. The process cartridge of claim 1, wherein the engagement part is integrally formed on the frame.

13. The process cartridge of claim 1, wherein the end part of the load member includes a bent part that is bent in a bent direction that is parallel with a rotational direction of the photosensitive unit, and the bent part is engaged with the regulation surface of the engagement part such that the bent direction is perpendicular to the regulation surface.

14. The process cartridge of claim 1, wherein the frame includes a side surface that faces the photosensitive unit, and the rotation of the end part of the load member is regulated by contacting the regulation surface of the engagement part and the side surface of the frame.

15. A process cartridge attachable to and detachable from an image forming device, comprising:

a photosensitive unit that rotates about a rotational axis, the photosensitive unit including:

a photosensitive drum that is configured to form an electrostatic latent image and that includes an edge part; and a flange that is positioned outside the edge part of the photosensitive drum in a rotational axis direction of the photosensitive unit, the flange including a cylindrical attachment part;

a coil-shape load member slidably press-fitted to the attachment part of the flange such that the load member is able to rotate corresponding to a rotation of the flange;

a frame that rotatably holds a part of the photosensitive unit, the frame including an engagement part that is configured to engage with a part of the load member; and a contact including a first contact part and a second contact part, the first contact part being connected to a regulation surface of the engagement part, the second contact part being exposed outside the frame so that the second contact part is connected to a device outside the frame, wherein a rotation of an end part of the load member is regulated by the first contact part of the contact, an electrical connection from the load member to the contact is created through the first contact part, and the coil-shape load member is positioned entirely outside the edge part of the photosensitive drum in the rotational axis direction of the photosensitive unit.

16. The process cartridge of claim 15, wherein the contact further includes a third contact part that is arranged along with an inner surface of the frame, which is on a side of the photosensitive unit, the rotation of the end part of the load member is regulated by the third contact part of the contact as well as the first contact part, and the electrical connection to the contact is created through the third contact part as well as the first contact part.

17. An image forming apparatus, comprising:

the process cartridge of claim 15;

a transfer part that is provided adjacent to the process cartridge; and a fuser that is provided in a downstream side of the process cartridge along a medium carrying direction.

18. The process cartridge of claim 15, wherein the engagement part is integrally formed on the frame.

19. The process cartridge of claim 15, wherein the end part of the load member includes a bent part that is bent in a bent direction that is parallel with a rotational direction of the photosensitive unit, and the bent part is engaged with the first contact part of the contact such that the bent direction is perpendicular to the first contact part.

20. The process cartridge of claim 15, wherein the frame includes a side surface that faces the photosensitive unit, and the rotation of the end part of the load member is regulated by contacting the first contact of the contact and the side surface of the frame.

21. A process cartridge attachable to and detachable from an image forming device, comprising:

a photosensitive unit that rotates about a rotational axis, the photosensitive unit including:

a photosensitive drum that is configured to form an electrostatic latent image and that includes an edge part; and a flange that is positioned at one end of the photosensitive drum and outside the edge part of the photosensitive drum in a rotational axis direction of the photosensitive unit, the flange including a cylindrical attachment part;

a load member that is slidably fitted to the attachment part of the flange; and two frames that are provided at both sides of the photosensitive unit with respect to the rotational axis, one frame rotatably holding a part of one end of the photosensitive unit and including an engagement part that is configured to engage with a part of the load member on an inner surface, and the other frame rotatably holding a part of the other end of the photosensitive unit, not including the flange, wherein the load member rotates corresponding to a rotation of the photosensitive unit when an end part of the load member does not engage with the engagement part, and the load member does not rotate but the photosensitive unit rotates when the end part of the load member engages with the engagement part, and the load member is positioned entirely outside the edge part of the photosensitive drum in the rotational axis direction of the photosensitive unit.

22. The process cartridge of claim 21, further comprising:

the one frame includes a contact that is made of a conductive material, wherein the load member is made of a conductive material, a first contact part of the contact is arranged at an inner side of the one frame so that the first contact part contacts the load member, and a second contact part of the contact is exposed on an outer side of the one frame so that an electrical path from the second contact part to the photosensitive unit through the load member is created.

23. An image forming apparatus, comprising:

the process cartridge of claim 21;

a transfer part that is provided adjacent to the process cartridge; and a fuser that is provided in a downstream side of the process cartridge along a medium carrying direction.

24. The process cartridge of claim 21, wherein the engagement part is integrally formed on the frame.

25. The process cartridge of claim 21, wherein the end part of the load member includes a bent part that is bent in a bent direction that is parallel with a rotational direction of the photosensitive unit, the engagement part includes a regulation surface, by which a rotation of the end part of the load member is regulated, and the bent part is engaged with the regulation surface of the engagement part such that the bent direction is perpendicular to the regulation surface.

26. The process cartridge of claim 21, wherein the frame includes a side surface that faces the photosensitive unit, and the rotation of the part of the load member is regulated by contacting the engagement part and the side surface of the frame.

27. A process cartridge attachable to and detachable from an image forming device, the process cartridge comprising:

a photosensitive drum that is configured to form an electrostatic latent image;

a flange that is arranged to the photosensitive drum, including a cylindrical attachment part;

a frame that rotatably holds the flange; and a load member that is slidably press-fitted to the attachment part of the flange, wherein the frame includes an engagement part that is configured to engage with a part of the load member, a rotation of an end part of the load member is regulated by a regulation surface of the engagement part, and an angle formed by the regulation surface of the engagement part and a surface on which the engagement part is formed is an acute angle.

28. A process cartridge attachable to and detachable from an image forming device, comprising:

a photosensitive drum that is configured to form an electrostatic latent image;

a flange that is arranged to the photosensitive drum, including a cylindrical attachment part;

a coil-shape load member slidably press-fitted to the attachment part of the flange such that the load member is able to rotate corresponding to a rotation of the flange;

a frame that rotatably holds the flange, the frame including an engagement part that is configured to engage with a part of the load member; and a contact including a first contact part and a second contact part, the first contact part being connected to a regulation surface of the engagement part, the second contact part being exposed outside the frame so that the second contact part is connected to a device outside the frame, wherein a rotation of an end part of the load member is regulated by the first contact part of the contact, an electrical connection from the load member to the contact is created through the first contact part, the contact further includes a third contact part that is arranged along with an inner surface of the frame, which is on a side of the photosensitive drum, the rotation of the end part of the load member is regulated by the third contact part of the contact as well as the first contact part, and the electrical connection to the contact is created through the third contact part as well as the first contact part.

* * * * *